US009372045B1

(12) United States Patent
Kempf

(10) Patent No.: US 9,372,045 B1
(45) Date of Patent: Jun. 21, 2016

(54) ADJUSTABLE MULTI-LEVEL ARCHERY QUIVER

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 0 days.

(21) Appl. No.: 14/881,454

(22) Filed: Oct. 13, 2015

(51) Int. Cl.
*F41B 5/06* (2006.01)

(52) U.S. Cl.
CPC . *F41B 5/06* (2013.01); *F41B 5/066* (2013.01); *Y10S 224/916* (2013.01)

(58) Field of Classification Search
CPC ..... F41B 5/066; F41B 5/06; Y10S 224/916
USPC ..... 124/86, 88, 25.7
See application file for complete search history.

(56) References Cited

U.S. PATENT DOCUMENTS 3,465,928 A * 9/1969 Osterholm ..... F41B 5/063 124/25.7
3,591,062 A * 7/1971 Karbo ..... F41B 5/066 124/25.7
4,156,496 A * 5/1979 Stinson ..... F41B 5/066 124/25.7
4,607,606 A * 8/1986 Schaar ..... F41B 5/066 124/88
4,788,961 A * 12/1988 Toth ..... F41G 1/467 124/25.5
4,995,372 A * 2/1991 Topel ..... F41B 5/066 124/25.5
5,452,703 A * 9/1995 Bateman, III ..... F41B 5/066 124/25.7
5,803,069 A * 9/1998 Schreiber ..... F41B 5/063 124/25.7
6,006,734 A * 12/1999 Sodaro ..... F41B 5/066 124/25.5
6,390,085 B1 * 5/2002 Stinson ..... F41B 5/066 124/25.7
6,431,162 B1 * 8/2002 Mizek ..... F41B 5/066 124/25.5
6,672,299 B2 * 1/2004 Proctor ..... F41B 5/066 124/86
6,691,694 B2 * 2/2004 Stinson ..... F41B 5/066 124/25.5
6,845,765 B1 * 1/2005 Allshouse ..... F41B 5/1426 124/25.5
7,775,201 B2 * 8/2010 Cooper ..... F41B 5/14 124/25.5
7,942,141 B1 * 5/2011 Love ..... F41B 5/066 124/25.5
7,987,842 B2 * 8/2011 McPherson ..... F41B 5/066 124/86
8,434,467 B2 * 5/2013 LoRocco ..... F41B 5/066 124/86
8,522,766 B2 * 9/2013 LoRocco ..... F16B 5/00 124/25.7
8,596,256 B2 * 12/2013 McPherson ..... F41B 5/066 124/86
8,714,147 B2 * 5/2014 Walk ..... F41B 5/066 124/86
8,839,772 B2 * 9/2014 Lee ..... F41B 5/066 124/86
8,839,773 B2 * 9/2014 Ellig ..... F41B 5/066 124/88
8,931,469 B2 * 1/2015 Kingsbury ..... F41B 5/066 124/88
9,163,895 B2 * 10/2015 Pedersen ..... F41B 5/066
2006/0112945 A1 * 6/2006 Rager ..... F41B 5/066 124/86
2008/0302346 A1 * 12/2008 Notestine ..... F41B 5/066 124/25.7
2011/0174284 A1 * 7/2011 Hunt ..... F41B 5/066 124/44.6
2012/0103315 A1 * 5/2012 LoRocco ..... F16B 5/00 124/25.7
2013/0081604 A1 4/2013 Lee
2013/0174824 A1 * 7/2013 Pedersen ..... F41B 5/066 124/86
2015/0020359 A1 * 1/2015 Pedersen ..... F41B 5/066 29/412
2016/0018182 A1 * 1/2016 Pedersen ..... F41B 5/066 124/86

* cited by examiner

*Primary Examiner* — Alexander Niconovich
(74) *Attorney, Agent, or Firm* — Donald J. Ersler

(57) ABSTRACT

An adjustable multi-level archery quiver preferably includes a quiver hood, a quiver frame, a first arrow gripper and a second arrow gripper. The quiver hood includes a plurality of broad head cavities and at least three frame mounting cavities. A centerline of the plurality of broad head cavities are aligned in a straight line. However, depths of adjacent broad head cavities are staggered from each other. An alternative embodiment of a quiver hood includes adjacent broad head cavities that are offset from each other in a Y-axis. The quiver frame includes a first hood mounting leg and a second hood mounting leg extending from one end. The first and second hood mounting legs are retained in the frame mounting openings. The first and second arrow grippers may be attached to the quiver frame to create right or left hand quivers.

11 Claims, 10 Drawing Sheets

ADJUSTABLE MULTI-LEVEL ARCHERY QUIVER

BACKGROUND OF THE INVENTION

1. Field of the Invention

The present invention relates generally to archery and more specifically to an adjustable multi-level archery quiver, which prevents a broad head of one arrow from contacting a broad head of an adjacent arrow.

2. Discussion of the Prior Art

Historically, archery quivers have been used by archers to hold and transport arrows, until the archer is ready to use them. Over the years, many different styles have been produced. The most versatile style is a kind of quiver that attaches to the archery bow or crossbow, and has a quick-release feature that allows for removal of the quiver from the hunting device. Quivers designed to hold multiple arrows have always had inherent restrictions placed upon them due to the design and function of the quiver hood and arrow grippers. Arrow quivers all hold the arrows in one of two ways: the arrows in a straight line, we will call this line X, wherein all of the arrows are indexed with the forward point of the arrow in a line. The other method of a quiver would stagger alternating arrows, such as the points of the letter "V" or "W" when looked at from the top of the quiver, and all of the forward points of these arrows would still be located on a plane.

In order to allow for multiple arrows within the quiver, often times the blades on the broad heads would hit each other as the arrow was rotated within the arrow gripper and quiver hood. The present invention may utilize the placement of arrows in a straight line, or staggered like a "V" or "W", with the added benefit of staggering the arrows up and down with the arrow grippers and quiver. This staggered fitment allows the blades of the broad heads to rotate freely without interference with the blades of the adjacent broad heads. The present invention also allows for indexing the quiver hood and arrow gripper with the quiver frame in order to make a right hand or left hand quiver.

Prior art archery quivers are limited in the task of inserting, storing, and removing the arrows when broad heads are attached to the arrows. Lee 2013/0081604 discloses an archery quiver, wherein the arrows are aligned in a straight line or shallow arc. Lorocco 2012/0103315 discloses an archery quiver, wherein the arrows are inserted into the quiver in an offset pattern. Finally, Pedersen 2015/0020359 discloses an archery quiver, wherein the quiver hood is designed to limit the rotation of the broad head to 90 degrees or less.

Although the prior art accomplishes the task of securing arrows, they are all limited in the function of full rotation of the broad head when the broad head diameter (BHD) is equal to or greater than the distance between the center lines (DBCL), of the arrows.

Accordingly, there is a clearly felt need in the art for an adjustable multi-level archery quiver, which prevents a broad head of one arrow from contacting a broad head of an adjacent arrow and which allows full rotation of a broad head in the quiver hood.

SUMMARY OF THE INVENTION

The present invention provides an adjustable multi-level archery quiver, which prevents a broad head of one arrow from contacting a broad head of an adjacent arrow. An archery quiver that allows for staggered fitment of the arrows within the quiver hood and arrow grippers so as to allow the blades of the broad heads to rotate freely without interference with blades from adjacent broad heads, as well as the flexibility of assembling the quiver as a right hand or a left hand quiver. To ease understanding of the present invention, we shall use the following example: assume that one uses 4 arrows with broad heads. Using a grid with X and Y coordinates on a plane, and that X represents left and right, and Y represents up and down. The arrows are placed side by side on the X coordinates, having more or less an equal distance between the centerlines of the arrows. Leaving the first and third arrows at a static location, shift the second and fourth arrow up on the Y coordinates a distance of at least 0.125", but preferably 0.500" or more. This arrangement locates the arrows in a plane, alternating the X and Y location of the tips of the arrows. Alternatively, the arrows could be offset in the Y coordinates in a "step" arrangement, wherein each subsequent arrow is either higher or lower on the Y than the preceding arrow.

An alternative to these arrangements would be to add the "Z" coordinates to the arrows. Z represents raising or lowering alternating arrows above and/or below the X-Y plane.

The quiver hood and the arrow grippers of the adjustable multi-level archery quiver of the present invention also may provide multiple mounting points, wherein the quiver hood and arrow grippers may be attached, by the user, to the quiver frame in multiple locations creating a left hand or right hand quiver.

Accordingly, it is an object of the present invention to provide an adjustable multi-level archery quiver, which allows a broad head of one arrow to be rotated relative to a broad head of an adjacent arrow.

Finally, it is another object of the present invention to provide an adjustable multi-level archery quiver, which provides the flexibility to assemble the archery quiver as a right hand or a left hand quiver.

These and additional objects, advantages, features and benefits of the present invention will become apparent from the following specification.

DETAILED DESCRIPTION OF THE PREFERRED EMBODIMENTS

Figure 1:
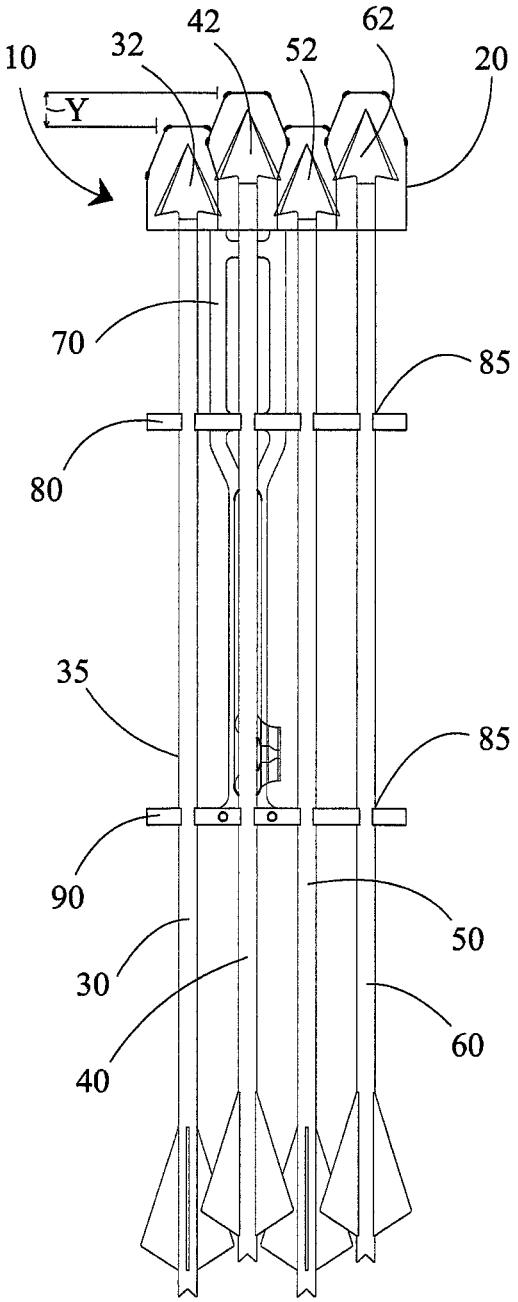
FIG. 1 is a front view of an adjustable multi-level archery quiver in accordance with the present invention.
Figure 2:
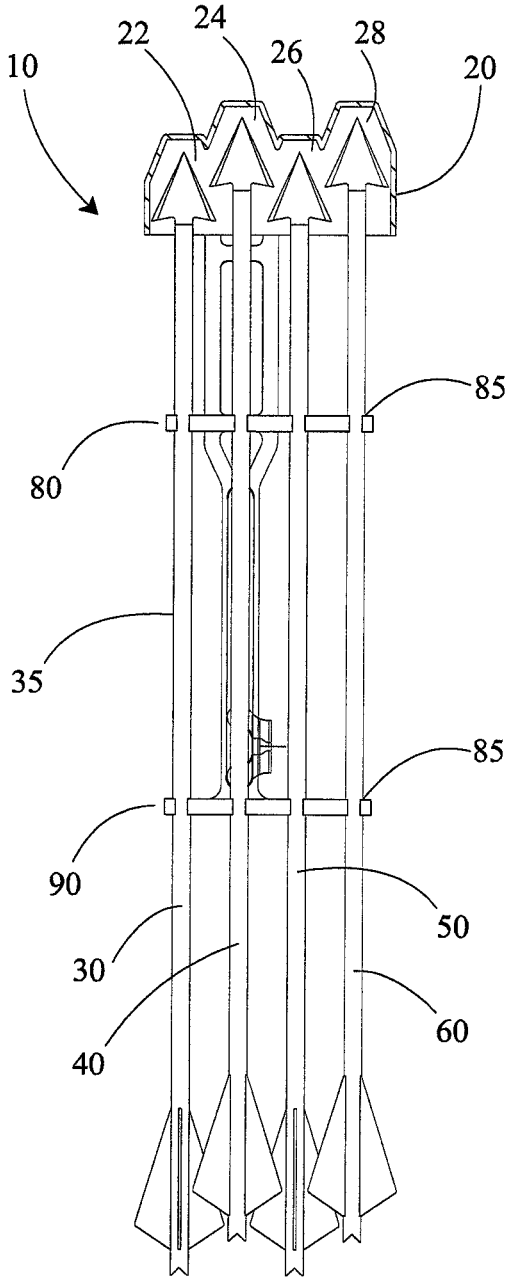
FIG. 2 is a front view of an adjustable multi-level archery quiver with a front cross sectional view of a quiver hood in accordance with the present invention.

FIGS. 1-6 show an adjustable multi-level archery quiver 10. The adjustable multi-level archery quiver 10 preferably includes a quiver hood 20, a frame 70, a first arrow gripper 80 and a second arrow gripper 90. However, the adjustable multi-level quiver 10 may be constructed with only one arrow gripper 90. With reference to FIGS. 1-2, the first and second arrow grippers 80, 90 include a plurality of arrow pockets 85 for retaining a shaft 35 of arrows 30, 40, 50 and 60. The shafts 35 of the arrows 30, 40, 50, 60 each include a first end and a second end. The first end of the shaft 35 engages a bow string, and broad heads 32, 42, 52, 62 are secured to the second end of the shaft 35.

Figure 1A:
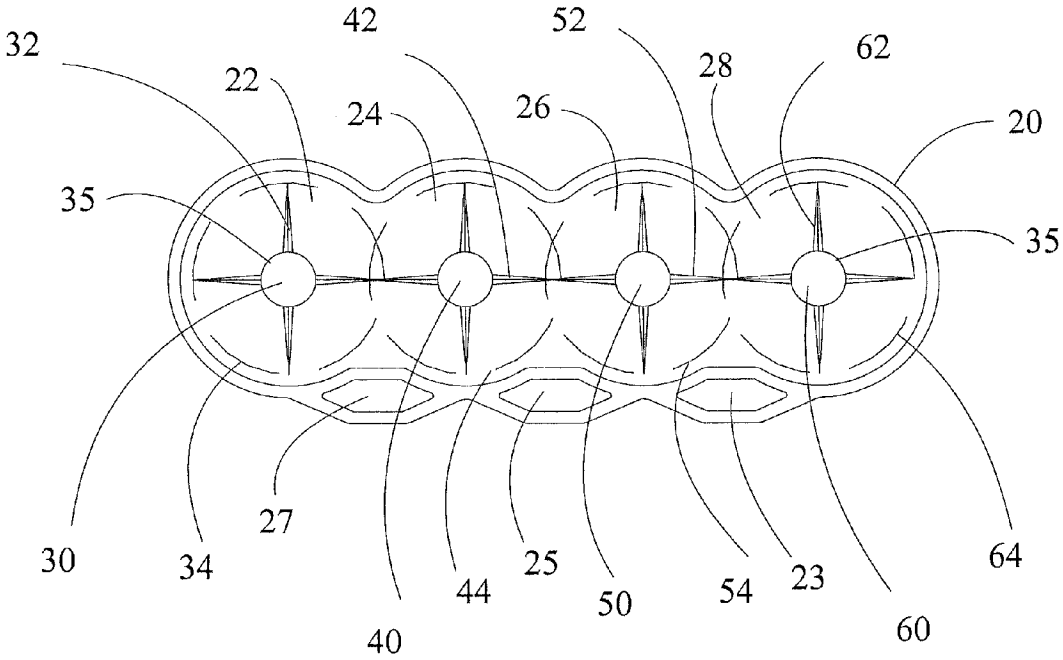
FIG. 1A is a bottom end view of a quiver hood of an adjustable multi-level archery quiver with broad heads and shafts of the arrow shown to illustrate rotation of adjacent broad heads, after raising adjacent broad heads to different heights in the quiver hood in accordance with the present invention.

With reference to FIG. 1A, the quiver hood 20 includes broad head cavities 22, 24, 26, 28. The broad head cavities 22, 24, 26, 28 are at an alternative coordinate on the Y plane. Rotation paths 34, 44, 54, 64 illustrate overlapping and intersecting paths of the broad heads 32, 42, 52, 62. If the depths of adjacent broad head cavities 22, 24, 26, 28 were not staggered as shown in FIG. 1, the broad heads 32, 42, 52, 62 could not be rotated. With reference to FIGS. 3*b*-3*c*, a staggered quiver hood 21 includes broad head cavities 33, 35, 37. It is preferable that there be an odd number of broad head cavities. The staggered quiver hood 21 is disclosed with three broad head cavities, but could be 4, 5, 6, 7, 8, 9 or etc. A center of the broad head cavities 33 and 37 are offset from a center of the broadhead cavity 35 by a distance on the "Z" axis. A depth of broad head cavity 35 is also greater than broad head cavities 33 and 37 by a distance on the "Y" axis. The offset center and different depth of the broad head cavities allow the centers of the broad head cavities 33, 35, 37 to be moved closer to each other on the "X" axis, thus allowing for a smaller foot print or for more one or two more broad heads to be contained in the staggered quiver hood 21.

Figure 3:
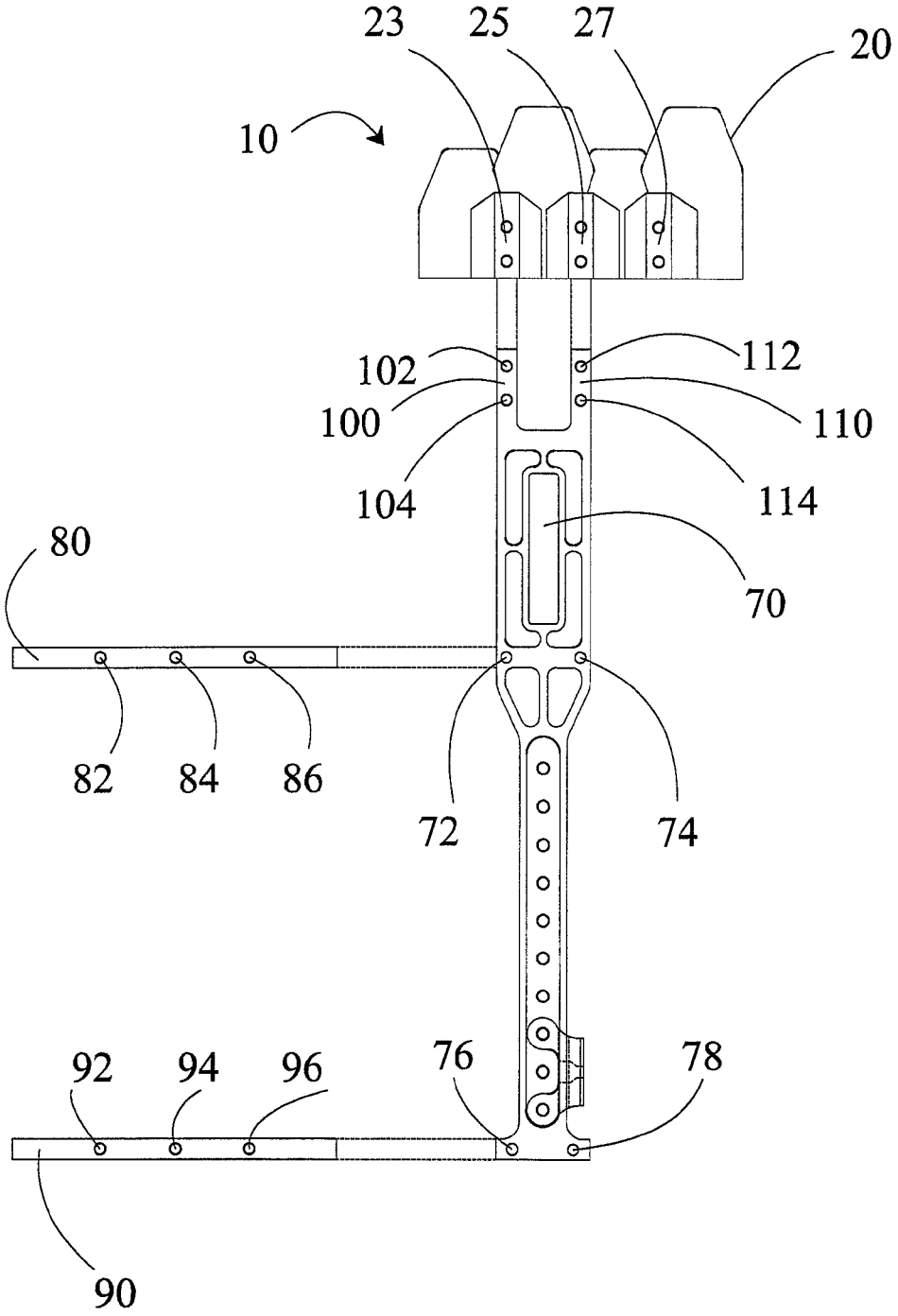
FIG. 3 is an exploded rear view of an adjustable multi-level archery quiver, illustrating the adjustability of a quiver hood and arrow grippers relative to a frame for left hand configuration in accordance with the present invention.
Figure 3A:
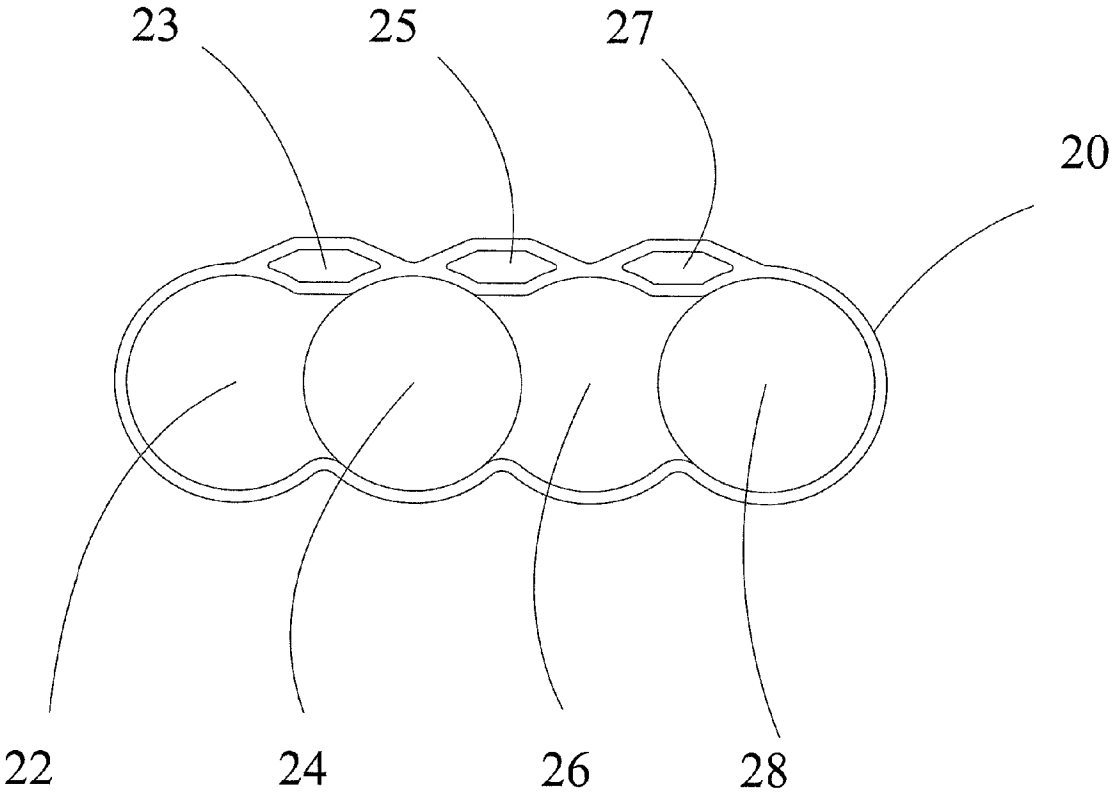
FIG. 3A is a bottom end view of a quiver hood of an adjustable multi-level archery quiver in accordance with the present invention.
Figure 3B:
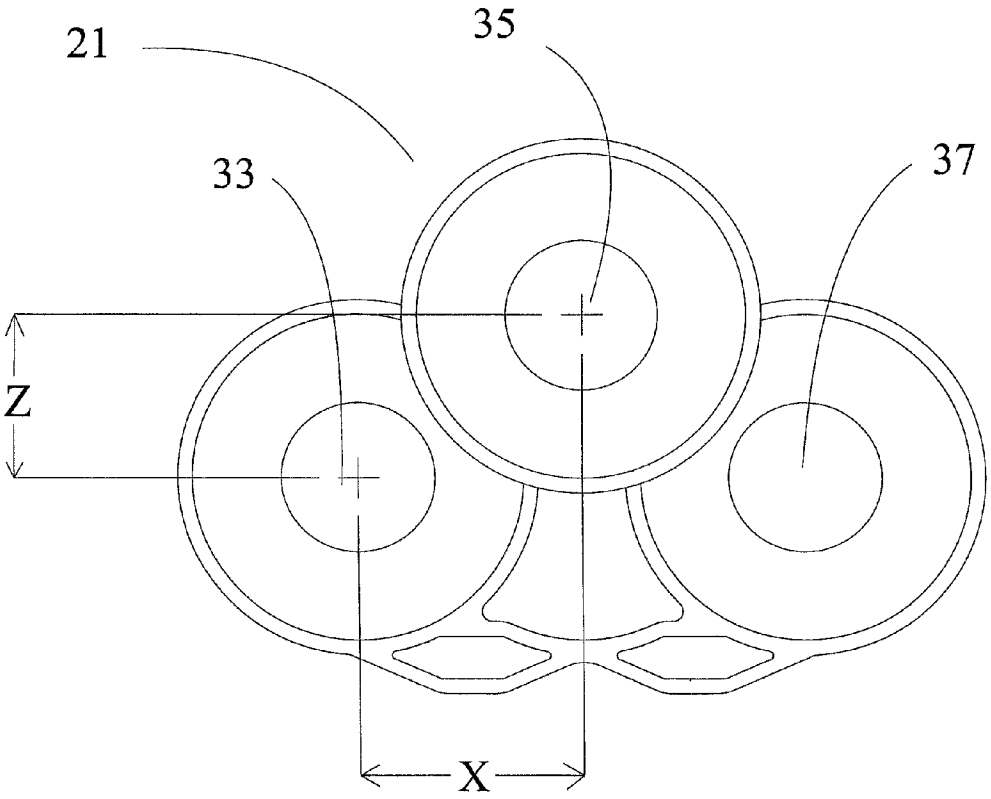
FIG. 3B is a bottom end view of a staggered quiver hood of an adjustable multi-level archery quiver in accordance with the present invention.
Figure 3C:
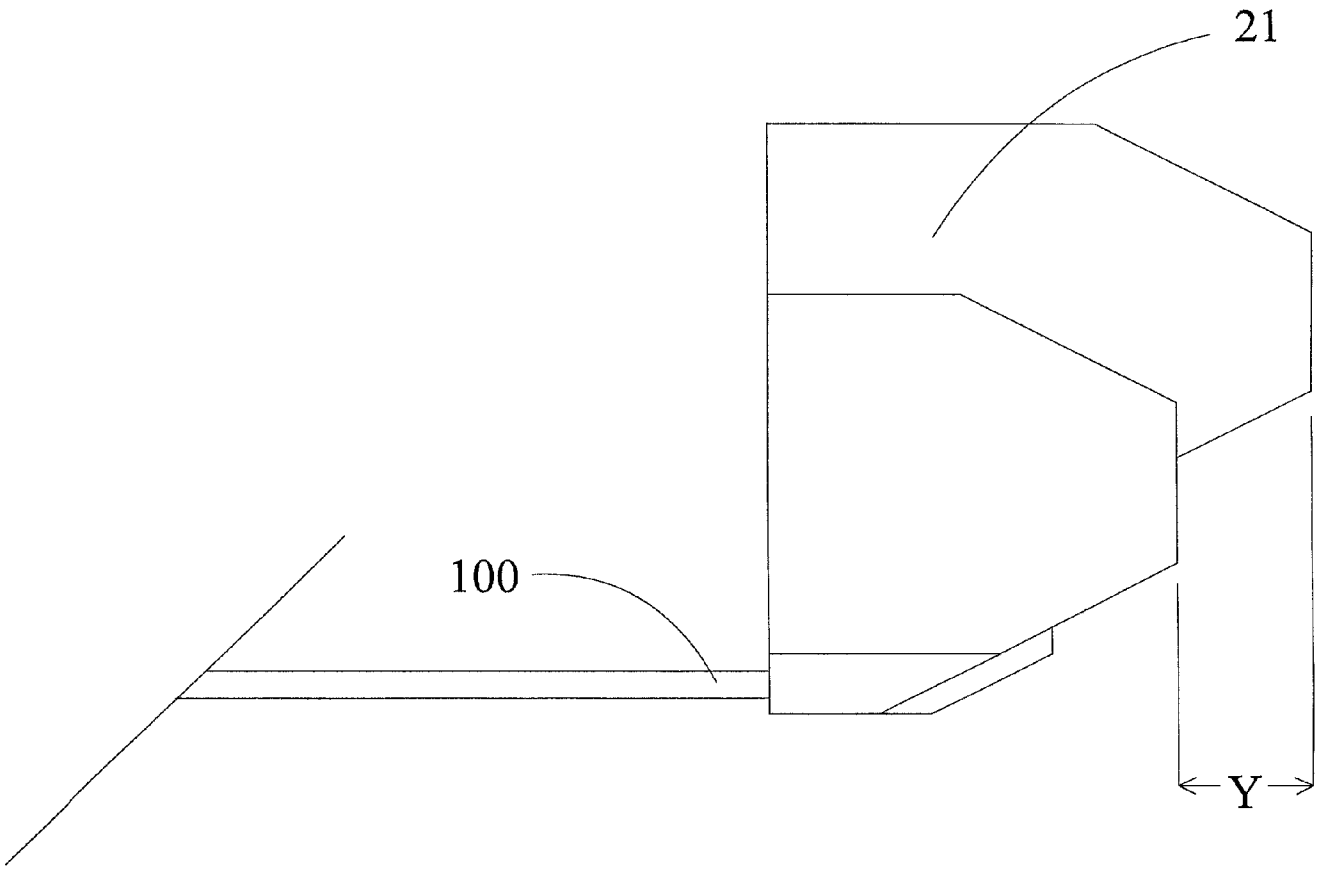
FIG. 3C is a side view of a staggered quiver hood of an adjustable multi-level archery quiver in accordance with the present invention.

With reference to FIG. 3, the frame 70 includes a first hood mounting leg 100 and a second hood mounting leg 110 located on one end. Hood mounting holes 102, 104 are located in the first hood mounting leg 100 and hood mounting holes 112, 114 are located in the second mounting leg 110. With reference to FIG. 3A, the quiver hood 20 includes a first frame mounting opening 23, a second frame mounting opening 25, and a third frame mounting opening 27. A first set of gripper mounting holes 72 and 74 are formed in substantially a middle of the frame 70. A second set of gripper mounting holes 76, 78 are formed in an opposing end of the frame 20. First gripper holes 82, 84, 86 are formed through the first arrow gripper 80 and second arrow holes 92, 94, 96 are formed through the second arrow gripper 90.

Figure 4:
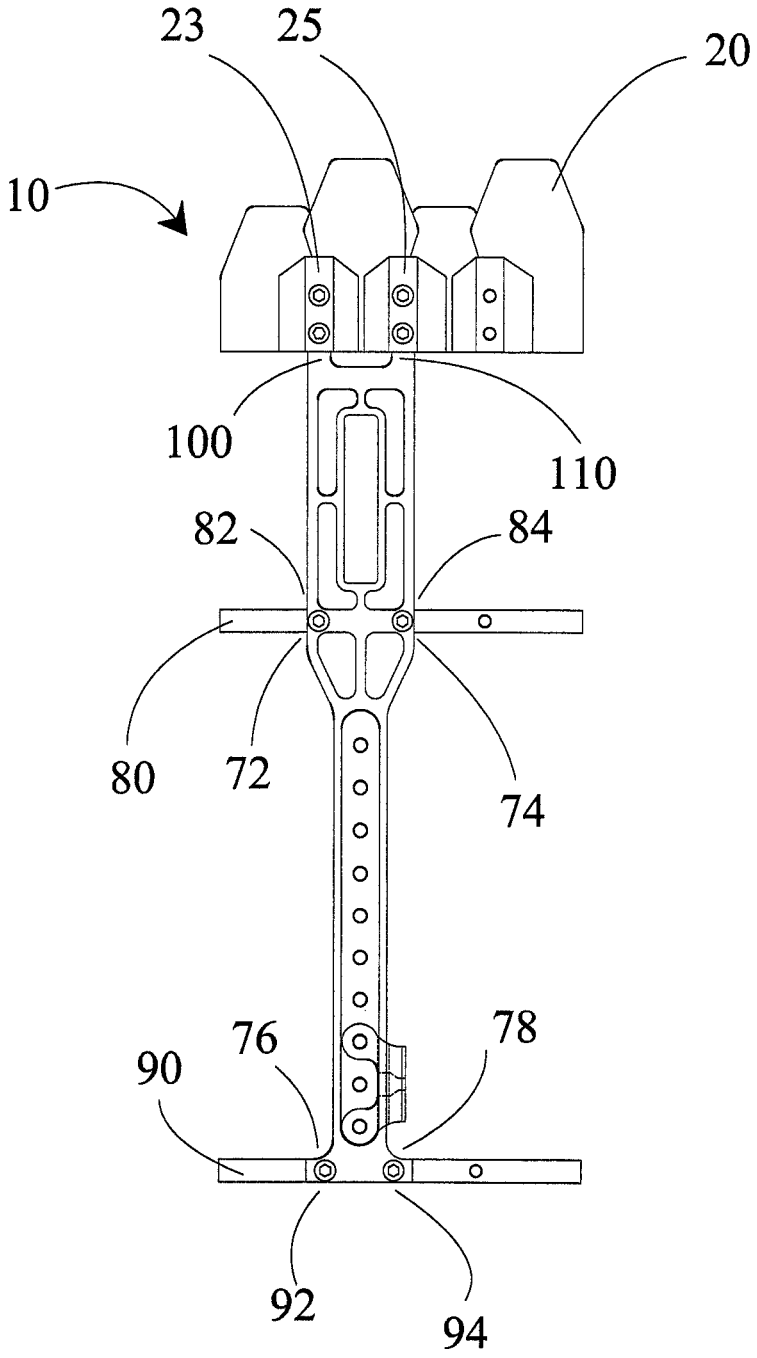
FIG. 4 is a rear view of an adjustable multi-level archery quiver where a quiver hood and arrow grippers are indexed to create a left hand quiver in accordance with the present invention.

FIG. 4 discloses an assembled adjustable multi-level arrow quiver 10, where the quiver hood 20, the first arrow gripper 80, and the second arrow gripper 90 are attached to the frame 70 to create a left hand quiver. The first arrow gripper 80 is attached to the frame 70 by aligning the first gripper holes 82, 84 of the first arrow gripper 80 with the first set of gripper mounting holes 72 and 74 of the frame 70 and inserting and securing the first arrow gripper 80 with a plurality of fasteners. However, the first arrow gripper 80 may be attached to the frame 70 with any suitable method. The second arrow gripper 90 is attached to the frame 70 by aligning the second gripper holes 92, 94 of the second arrow gripper 90 with the second set of gripper mounting holes 76 and 78 of the frame 70 and inserting and securing the second arrow gripper 90 with a plurality of fasteners. However, the second arrow gripper 90 may be attached to the frame 70 with any suitable method. The first and second hood mounting legs 100, 110 are inserted through the first and second frame mounting cavities 23, 25 and attached to the first and second hood mounting legs 100, 110 with a plurality of fasteners or any other suitable attachment method.

Figure 5:
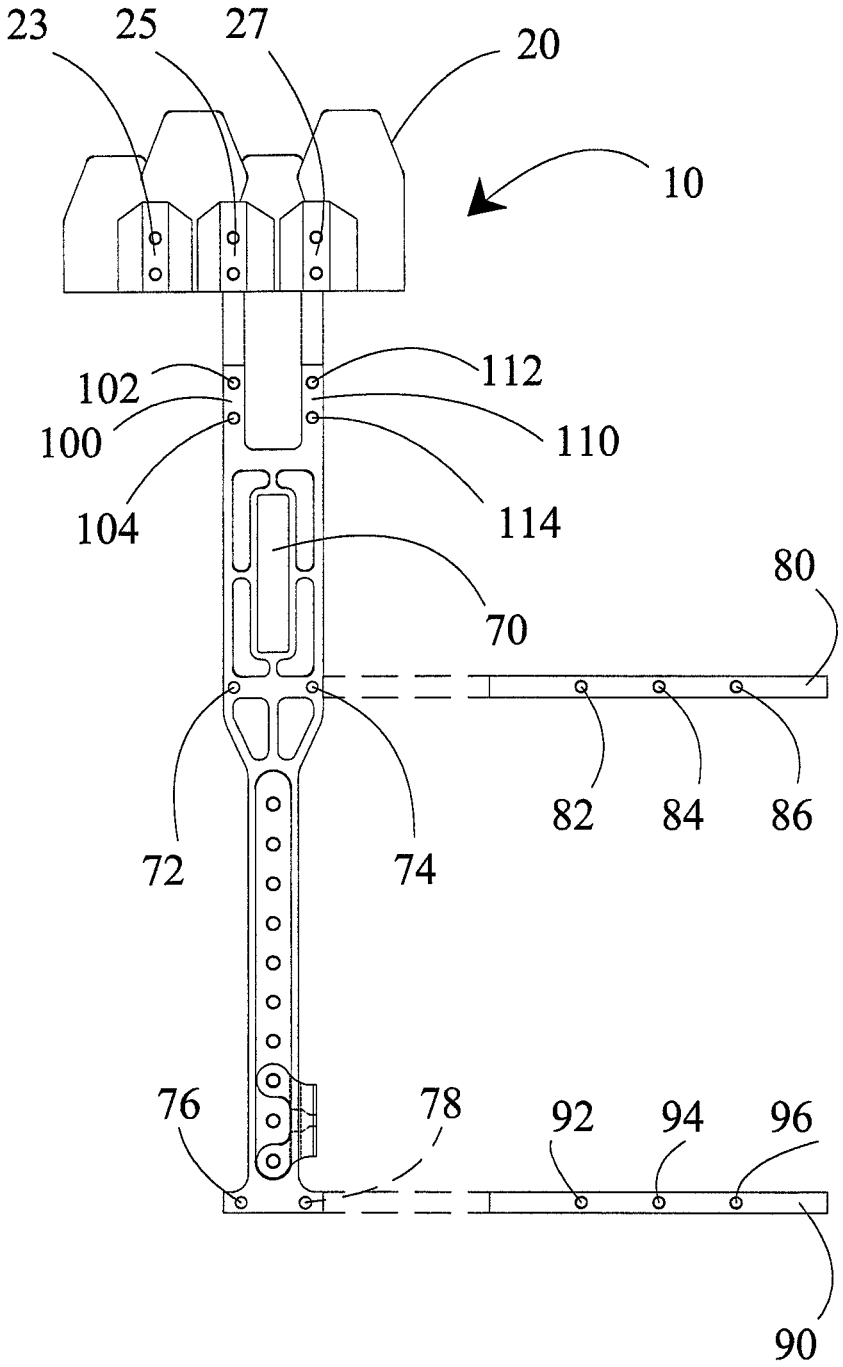
FIG. 5 is an exploded rear view of an adjustable multi-level archery quiver, illustrating the adjustability of a quiver hood and arrow grippers relative to a frame for a right hand configuration in accordance with the present invention.
Figure 6:
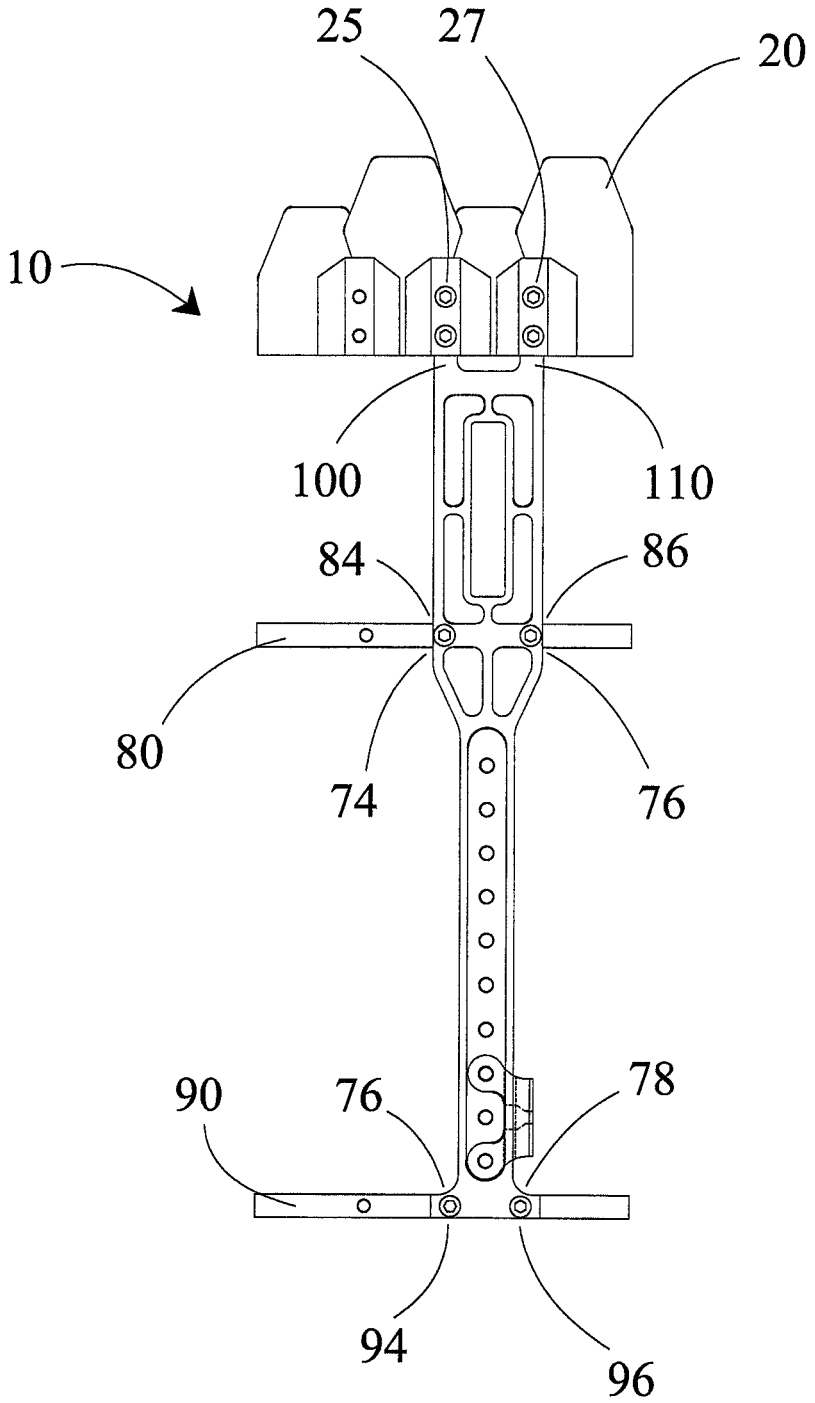
FIG. 6 is a rear view of an adjustable multi-level archery quiver where a quiver hood is indexed to create a right hand quiver in accordance with the present invention.

FIG. 5 is an exploded rear view of the adjustable multi-level archery quiver 10, illustrating the adjustability of the quiver hood 20, and the first and second arrow grippers 80, 90 relative to the frame 70 to create a right hand quiver. FIG. 6 discloses an assembled adjustable multi-level arrow quiver 10, where the quiver hood 20, the first arrow gripper 80, and the second arrow gripper 90 are attached to the frame 70 to create the right hand quiver. The first arrow gripper 80 is attached to the frame 70 by aligning the first gripper holes 84, 86 of the first arrow gripper 80 with the first set of gripper mounting holes 72 and 74 of the frame 70 and inserting and securing the first arrow gripper 80 with a plurality of fasteners. However, the first arrow gripper 80 may be attached to the frame 70 with any other suitable method. The second arrow gripper 90 is attached to the frame 70 by aligning the second gripper holes 94, 96 of the second arrow gripper 90 with the second set of gripper mounting holes 76 and 78 of the frame 70 and inserting and securing the second arrow gripper 90 with a plurality of fasteners. However, the second arrow gripper 90 may be attached to the frame 70 with any other suitable method. The first and second hood mounting legs 100, 110 are inserted through the first and second frame mounting cavities 25, 27 and attached to the first and second hood mounting legs 100, 110 with a plurality of fasteners or any other suitable attachment method.

Although the figures in this application illustrate a preferred embodiment of the present invention, alternative designs may be accomplished by altering the X, Y, and Z locations of the arrows, and designing the quiver hood and arrow grippers accordingly.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable multi-level archery quiver for retaining a plurality of arrows, comprising:

a quiver hood includes a plurality of broad head cavities, said plurality of broad head cavities have at least two different depths, a depth of one of said plurality of broad head cavities is different than a depth of an adjacent one of said plurality of broad head cavities, wherein said at least two different depths allow an outer perimeter of two adjacent broad heads to overlap of a plurality of broad heads of the plurality of arrows, while allowing the plurality of broad heads to be fully rotated without contacting each other, wherein said quiver hood is attached to one end of a quiver frame, the plurality of broad heads are retained in said plurality of broad head cavities.

2. The adjustable multi-level archery quiver for retaining a plurality of arrows of claim 1, comprising:

at least one arrow gripper includes a plurality of arrow pockets for receiving a plurality of arrow shafts of a plurality of arrows, one of said at least one arrow gripper is attached to an opposing end of the quiver frame.

3. The adjustable multi-level archery quiver for retaining a plurality of arrows of claim 2 wherein:

a second arrow gripper is attached to substantially a middle of the quiver frame.

4. An adjustable multi-level archery quiver for retaining a plurality of arrows of claim 1 wherein:

center axes of the plurality of arrows are located on at least two different centerlines.

5. An adjustable multi-level archery quiver for retaining a plurality of arrows, comprising:

a quiver hood includes a plurality of broad head cavities, said plurality of broad head cavities have at least two different depths, a depth of one of said plurality of broad head cavities is different than a depth of an adjacent one of said plurality of broad head cavities, wherein said at least two different depths allow an outer perimeter of two adjacent broad heads to overlap of a plurality of broad heads of the plurality of arrows, while allowing the plurality of broad heads to be fully rotated without contacting each other, center axes of the plurality of arrows are located on a single centerline, wherein said quiver hood is attached to one end of a quiver frame, the plurality of broad heads are retained in said plurality of broad head cavities.

6. The adjustable multi-level archery quiver for retaining a plurality of arrows of claim 5, comprising:

at least one arrow gripper includes a plurality of arrow pockets for receiving a plurality of arrow shafts of a plurality of arrows, one of said at least one arrow gripper is attached to an opposing end of the quiver frame.

7. The adjustable multi-level archery quiver for retaining a plurality of arrows of claim 6 wherein:

a second arrow gripper is attached to substantially a middle of the quiver frame.

8. An adjustable multi-level archery quiver for retaining a plurality of arrows, comprising:

a quiver hood includes a plurality of broad head cavities, said plurality of broad head cavities have at least two different depths, a depth of one of said plurality of broad head cavities is different than a depth of an adjacent one of said plurality of broad head cavities, wherein said at least two different depths allow an outer perimeter of two adjacent broad heads to overlap of a plurality of broad heads of the plurality of arrows, while allowing the plurality of broad heads to be fully rotated without contacting each other, wherein said quiver hood is attached to one end of a quiver frame, the plurality of broad heads are retained in said plurality of broad head cavities, a plurality of arrow shafts of the plurality of arrows are retained on said quiver frame.

9. An adjustable multi-level archery quiver for retaining a plurality of arrows of claim 8 wherein:

center axes of the plurality of arrows are located on at least two different centerlines.

10. The adjustable multi-level archery quiver for retaining a plurality of arrows of claim 8, comprising:

at least one arrow gripper includes a plurality of arrow pockets for receiving the plurality of arrow shafts of the plurality of arrows, one of said at least one arrow gripper is attached to an opposing end of the quiver frame.

11. The adjustable multi-level archery quiver for retaining a plurality of arrows of claim 10 wherein:

a second arrow gripper is attached to substantially a middle of the quiver frame.

* * * * *